US010370788B2

(12) United States Patent
Kim et al.

(10) Patent No.: US 10,370,788 B2
(45) Date of Patent: Aug. 6, 2019

(54) CLOTHES TREATING APPARATUS

(71) Applicant: LG ELECTRONICS INC., Seoul (KR)

(72) Inventors: Youngwoo Kim, Seoul (KR); Jayoen Kim, Seoul (KR); Joohyeon Oh, Seoul (KR); Darae Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 107 days.

(21) Appl. No.: 15/513,239

(22) PCT Filed: Sep. 23, 2015

(86) PCT No.: PCT/KR2015/009996
§ 371 (c)(1),
(2) Date: Mar. 22, 2017

(87) PCT Pub. No.: WO2016/052907
PCT Pub. Date: Apr. 7, 2016

(65) Prior Publication Data

US 2017/0306551 A1 Oct. 26, 2017

(30) Foreign Application Priority Data

Sep. 30, 2014 (KR) ..... 10-2014-0130811

(51) Int. Cl.
*D06F 39/02* (2006.01)
*D06F 39/14* (2006.01)
(Continued)

(52) U.S. Cl.
CPC ..... *D06F 39/022* (2013.01); *D06F 33/02* (2013.01); *D06F 37/04* (2013.01); *D06F 39/005* (2013.01);
(Continued)

(58) Field of Classification Search
CPC ..... D06F 39/02; D06F 39/022; D06F 39/14; D06F 37/10
See application file for complete search history.

(56) References Cited

U.S. PATENT DOCUMENTS

2010/0071729 A1 3/2010 Classen et al.

FOREIGN PATENT DOCUMENTS

CN 1904189 1/2007
CN 101054767 10/2007
(Continued)

OTHER PUBLICATIONS

European Search Report dated Jun. 11 2018.
(Continued)

*Primary Examiner* — David G Cormier
(74) *Attorney, Agent, or Firm* — Ked & Associates, LLP

(57) ABSTRACT

A clothes treating apparatus comprises a cabinet; a drum that is installed in the cabinet so as to be rotatable and accommodates objects to be treated; and a door installed on the front side of the cabinet, wherein one or more removable storage tanks are detachably provided on the door to store at least one of a detergent and a fabric softener. The fluid storage tanks are filled, in advance, with a predetermined amount of detergent and/or fabric softener sufficient for operating the clothes treating apparatus a plurality of times so that it is possible to solve the inconvenience of having to introduce a detergent and/or a fabric softener in the clothes treating apparatus whenever operating the clothes treating apparatus.

18 Claims, 7 Drawing Sheets

(51) Int. Cl.

| | |
|---|---|
| ***D06F 33/02*** | (2006.01) |
| ***D06F 39/00*** | (2006.01) |
| ***D06F 37/04*** | (2006.01) |

(52) U.S. Cl.
CPC ..... *D06F 39/14* (2013.01); *D06F 2204/08* (2013.01); *D06F 2204/10* (2013.01); *D06F 2214/00* (2013.01)

(56) References Cited

FOREIGN PATENT DOCUMENTS

| | | | |
|---|---|---|---|
| CN | 200967894 | Y | 10/2007 |
| CN | 201132900 | Y | 10/2008 |
| DE | 7017043 | | 11/1971 |
| DE | 102009045580 | | 4/2011 |
| EP | 2602378 | | 6/2013 |
| EP | 2 743 393 | | 6/2014 |
| KR | 10-2006-0023016 | | 3/2006 |
| KR | 10-2007-0013811 | | 1/2007 |
| KR | 10-2013-0123547 | | 11/2013 |
| WO | WO 2006/066681 | | 6/2006 |

OTHER PUBLICATIONS

Chinese Office Action dated Jul. 23, 2018. (English translation).
International Search Report (with English Translation) and Written Opinion dated Jan. 4, 2016 issued in Application No. PCT/KR2015/009996.

CLOTHES TREATING APPARATUS

CROSS-REFERENCE TO RELATED APPLICATIONS

This application is a U.S. National Stage Application under 35 U.S.C. § 371 of PCT Application No. PCT/KR2015/009996, filed Sep. 23, 2015, which claims priority to Korean Patent Application No. 10-2014-0130811, filed Sep. 30, 2014, whose entire disclosures are hereby incorporated by reference.

TECHNICAL FIELD

The present invention relates to a clothes treatment apparatus (in particular, a washing machine), and more particularly, to a clothes treatment apparatus, which includes a fluid storage tank in which a detergent or a fabric softener may be stored in advance, whereby it is not necessary to replenish the detergent or the fabric softener every time the user operates the clothes treatment apparatus.

BACKGROUND ART

Generally, clothes treatment apparatuses may include, for example, a washing machine, a drying machine, and a so-called styler, and the washing machine may include a drying function. The washing machine may be broadly divided into a pulsator-type washing machine, in which a drum is vertically upright (i.e. a laundry opening is located in the upper side of a cabinet), and a drum-type washing machine, in which a drum is oriented horizontally (i.e. a laundry opening is located in the front side of a cabinet).

Such a clothes treatment apparatus may be operated via manipulation of an operating unit, which is provided in the cabinet of the laundry treatment apparatus, after, for example, an object to be treated and a detergent are introduced into the clothes treatment apparatus. Recently, with regard to the use of the clothes treatment apparatus, study on clothes treatment apparatuses capable of minimizing user inconvenience and attaining a cleaner and simpler external appearance is underway.

FIG. 1 schematically illustrates a conventional clothes treatment apparatus. Referring to FIG. 1, the conventional clothes treatment apparatus 1 includes a cabinet 2 defining the external appearance of the apparatus, a door 3 configured to open or close the cabinet 2, an operating unit (or control knob) 4 configured to operate the clothes treatment apparatus 1, and a detergent introduction unit or tray 5 configured to supply at least one of a detergent and a fabric softener into the clothes treatment apparatus 1.

In order to wash clothes using the clothes treatment apparatus 1, a user needs to introduce the clothes into the cabinet 2 in the opened state of the door 3, and then to open the detergent introduction unit 5 so as to introduce at least one of a detergent and a fabric softener. That is, the user needs to open the detergent introduction unit 5 so as to introduce an appropriate amount of detergent and/or fabric softener every time the user operates the clothes treatment apparatus 1. Of course, only one of the detergent and/or the fabric softener may be introduced depending on, for example, the washing course that is selected.

The conventional clothes treatment apparatus 1 described above is problematic or inconvenient because the user needs to open the detergent introduction unit 5 and directly introduce the detergent and/or the fabric softener every time the user operates the clothes treatment apparatus 1. In addition, it is problematic or inconvenient to directly adjust an appropriate amount of detergent depending on, for example, the course selected by the user, the type of clothes to be treated, and the amount of clothes, prior to introducing the detergent into the detergent introduction unit 5. In addition, because the detergent introduction unit 5 is provided at the exterior of the cabinet 2, the external appearance of the clothes treatment apparatus 1 does not have a neat appearance.

DISCLOSURE

Technical Problem

One object of the present invention is to overcome a problem or an inconvenience in that a user needs to directly introduce a detergent and/or a fabric softener into a clothes treatment apparatus (or a detergent introduction unit) every time the user operates the clothes treatment apparatus. That is, another object of the present invention is to provide a clothes treatment apparatus, which may include a fluid storage tank, which is provided so as to be attachable to or detachable from a door of the clothes treatment apparatus, so that the fluid storage tank is filled in advance with a predetermined amount of detergent and/or fabric softener, thereby allowing the clothes treatment apparatus to be operated multiple times.

In addition, another object of the present invention is to provide a clothes treatment apparatus, which may allow an appropriate amount of detergent to be introduced manually or automatically into the clothes treatment apparatus from a fluid storage tank depending on, for example, the course selected by a user, the type of clothes to be treated, and the amount of clothes. In addition, a further object of the present invention is provide a clothes treatment apparatus having a cleaner external appearance by removing a detergent introduction unit, which has conventionally been provided on the outer surface of a cabinet of a clothes treatment apparatus.

Technical Solution

According to one aspect of the present application to achieve the objects described above, there is provided a clothes treatment apparatus including a cabinet defining an external appearance of the apparatus, a drum rotatably installed in the cabinet and configured to accommodate an object to be treated, and a door installed on a front side of the cabinet, wherein the door includes at least one separable fluid storage tank configured to store at least one of a detergent and a fabric softener. The door may include a frame unit and a transparent glass unit provided in a center of the frame unit, and the fluid storage tank may be provided on the frame unit.

The fluid storage tank may be formed of a transparent material, and, when the door is opened, a rear surface of the fluid storage tank may be exposed. The door may be provided with an installation portion for installation of the fluid storage tank, the installation portion having a shape corresponding to a shape of the fluid storage tank.

The door may include a front frame facing the front side of the cabinet and a rear frame opposite the front frame, and the installation portion may be provided on the front frame. The door may be provided on one side portion thereof with a first hinge unit in a height direction of the door so that the door is rotated leftward or rightward relative to the cabinet, and the door may be provided on a bottom portion thereof with a second hinge unit in a width direction of the door so that the front frame is titled in a front-and-rear direction by a predetermined angle relative to the rear frame.

When the front frame is tilted forward by the predetermined angle relative to the rear frame, an upper portion of the fluid storage tank may be exposed outward. The fluid storage tank may be upwardly separable from the front frame in a state in which the front frame is tilted forward by the predetermined angle relative to the rear frame.

The fluid storage tank may be upwardly separable from the door in a state in which the door is opened away from the cabinet. The fluid storage tank may be connected to a tube, the tube serving to guide the detergent or the fabric softener stored in the fluid storage tank to an inside of the cabinet.

The glass unit may include a convex portion protruding toward the inside of the cabinet, and the tube may have one end connected to the fluid storage tank, and a remaining end installed to the frame unit so as to eject the detergent or the fabric softener toward the convex portion from an upper side of the convex portion. The one end of the tube may be connected to a lower end of the fluid storage tank. The clothes treatment apparatus may further include a pump configured to eject the detergent or the fabric softener stored in the fluid storage tank to an inside of the cabinet. The door may be provided with two fluid storage tanks separated from each other, and the pump may be located between the two fluid storage tanks.

The frame unit may have a rectangular shape and the glass unit has a circular shape when viewed from the front side of the cabinet, and the fluid storage tank may include a curved surface portion having a shape corresponding to a shape of an outer circumference of the glass unit. Each of the frame unit and the glass unit may have a circular shape when viewed from the front side of the cabinet, and the fluid storage tank may include a curved surface portion having a shape corresponding to a shape of an outer circumference of the glass unit.

Advantageous Effects

According to the present invention, because a fluid storage tank is filled in advance with a predetermined amount of detergent and/or fabric softener, which may be sufficient to operate a clothes treatment apparatus multiple times, inconvenience related to the introduction of a detergent and/or a fabric softener into the clothes treatment apparatus every time the clothes treatment apparatus is operated is eliminated. In addition, according to the present invention, an appropriate amount of detergent depending on, for example, the course selected by a user, the type of clothes to be treated, and the amount of clothes may be introduced manually or automatically into the clothes treatment apparatus from the fluid storage tank.

In addition, according to the present invention, because one surface of the fluid storage tank is exposed outward when a door is opened, the user may easily check the amount of detergent stored in the fluid storage tank. In addition, according to the present invention, because the fluid storage tank is separable from the door, the user may easily fill the fluid storage tank with the detergent or the fabric softener.

In addition, according to the present invention, because the fluid storage tank is installed inside a door frame, deterioration in the external appearance of the clothes treatment apparatus may be prevented, and the space inside the door frame may be efficiently used. In addition, according to the present invention, the clothes treatment apparatus may achieve a cleaner external appearance, owing to the removal of a detergent introduction unit, which has conventionally been provided on the outer surface of a cabinet in a clothes treatment apparatus.

BEST MODE

Hereinafter, exemplary embodiments of the present invention to concretely realize the objects described above will be described with reference to the accompanying drawings. Although a clothes treatment apparatus, which will be described below, may include a washing machine, a drying machine, or a so-called styler, a washing machine including a drying function will be mainly described.

Meanwhile, a damping structure, a water supply structure, a drainage structure, and the like, which may be provided inside the clothes treatment apparatus, are the same as or similar to corresponding structures of a conventional clothes treatment apparatus, and thus in the following description of the present invention, a detailed description related to general structures of the conventional clothes treatment apparatus will be omitted.

Figure 2:
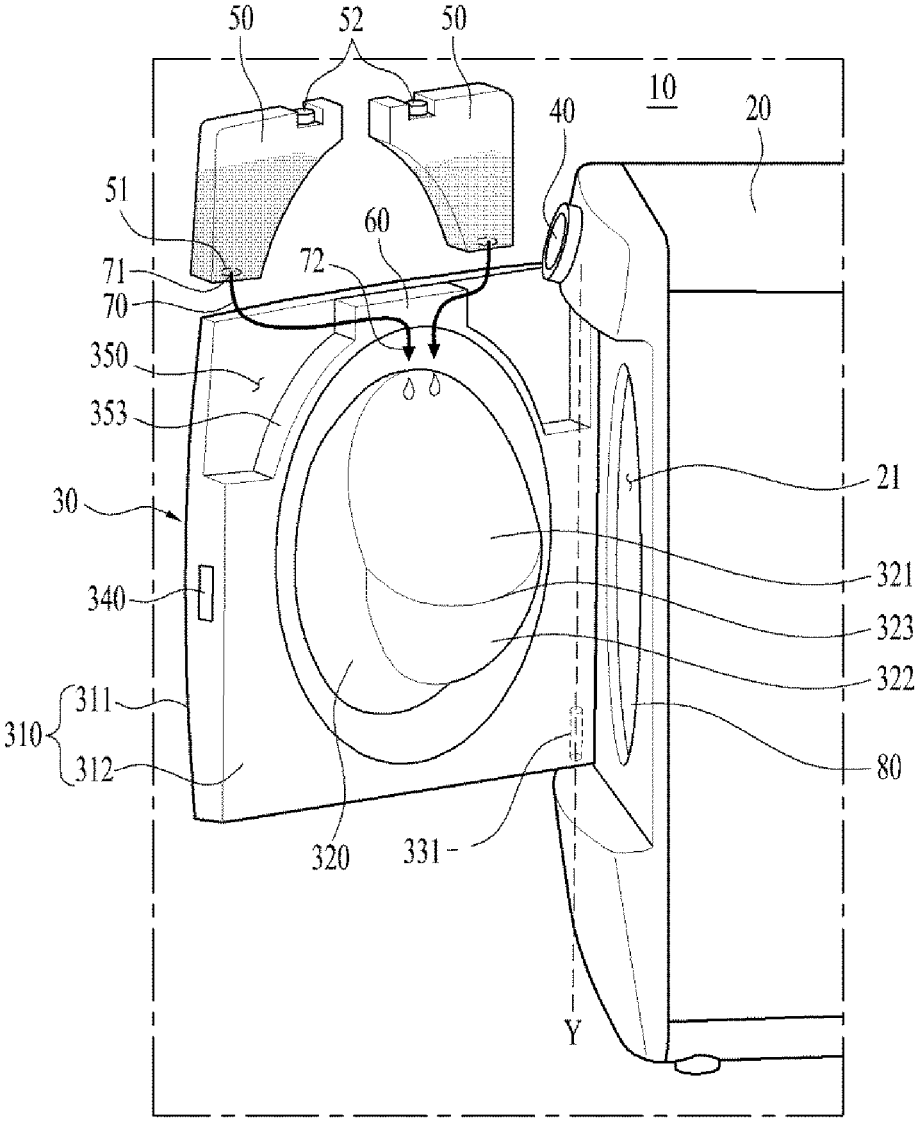
FIG. 2 is a perspective view of a clothes treatment apparatus according to an embodiment of the present invention.

FIG. 2 is a perspective view of a clothes treatment apparatus 10 according to an embodiment of the present invention. Specifically, FIG. 2 is a perspective view illustrating the opened state of a door 30 in the clothes treatment apparatus 10 according to the embodiment of the present invention.

Referring to FIG. 2, the clothes treatment apparatus 10 according to the embodiment of the present invention includes a cabinet 20 defining the external appearance of the apparatus, a drum 80, which is rotatably installed in the cabinet 20 and accommodates an object to be treated (i.e. a laundry or a washing object), and a door 30 installed on the cabinet 20. A tub (not illustrated) may be further disposed inside the cabinet 20 so as to surround the drum 80 in order to accommodate wash water.

The cabinet 20 may be provided with an operating unit (or control knob) 40 to operate the clothes treatment apparatus 10. The operating unit 40 takes the form of a rotatable rotary knob, and a user may power on the clothes treatment apparatus 10 using the operating unit 40. In addition, the user may select, for example, a desired clothes treatment course by rotating the operating unit 40, and then may operate the clothes treatment apparatus.

At this time, there may be clothes treatment courses including, for example, a standard washing course, a baby clothes course, a boiling course, a speedy wash course, a lingerie course, and a bedding course. In addition, for example, the number of rinsing operations in a rinsing course, the strength of dehydration of a dehydration course, and the temperature of wash water may be set via the operating unit 40.

An opening 21 is formed in the front portion of the cabinet 20, and the object to be washed (e.g. clothes) may be placed into the drum 80 through the opening 21. This opening 21 may be opened or closed by the door 30.

For example, the door 30 may be formed on one side portion of the door 30 so as to be rotated leftward or rightward about a vertical axis Y, which extends in the vertical direction, thereby opening or closing the opening 21. That is, the door 30 may be provided on one side portion thereof with a first hinge unit (or first hinge) 331 along the height direction of the door 30 so that the door 30 is rotated leftward or rightward relative to the cabinet 20.

More specifically, in order to rotate the door 30 (i.e. in order to open or close the door 30), the first hinge unit 331 may be provided between the door 30 and the cabinet 20 so as to be installed along the vertical axis Y. Accordingly, the door 30 may be rotated leftward or rightward relative to the cabinet 20 about the first hinge unit 331.

In addition, the door 30 may be provided on the other side portion thereof with a first grip portion (or first grip) 340, which is used to open or close the door 30. The first grip portion 340 may be recessed in the other side portion of the door 30 in the width direction.

Meanwhile, at least one fluid storage tank 50 may be separably installed to the door 30 and may be used to store at least one of a detergent and a fabric softener (hereinafter referred to as a "washing detergent"). The fluid storage tank 50, which will be described below in detail, may store a predetermined amount of washing detergent.

The amount of washing detergent stored in the fluid storage tank 50 may be sufficient to operate the clothes treatment apparatus multiple times (e.g. 5 times to 10 times). For example, the fluid storage tank 50 may be formed to have a predetermined volume.

At this time, the amount of washing detergent stored in the fluid storage tank 50 may be within a range from approximately 1 liter to 3 liters. Meanwhile, in the case where two separated fluid storage tanks 50 are provided on one door 30, the amount of washing detergent stored in each fluid storage tank 50 having a predetermined volume may be within a range from approximately 0.5 liter to 1.5 liters.

Specifically, the door 30 includes a frame unit (or frame) 310, and a glass unit (or glass window) 320 provided in the frame unit 310. At this time, the fluid storage tank 50 may be attached to the frame unit 310. For example, the glass unit 320 may be formed of a transparent material in order to allow the inside of the drum 80 of the clothes treatment apparatus 10 to be visible from outside the clothes treatment apparatus 10, and the glass unit 320 may be provided in the center of the frame unit 310.

In addition, the glass unit 320 includes convex portions 321, 322 and 323, which protrude toward the inside of the cabinet 20. At this time, the convex portions 321, 322 and 323 may include an upper sloped surface 321, which is downwardly inclined toward the inside of the cabinet 20, a lower sloped surface 322, which is upwardly inclined toward the inside of the cabinet 20, and a boundary portion 323 between the upper sloped surface 321 and the lower sloped surface 322.

In addition, the fluid storage tank 50 may be separably installed to the frame unit 310 of the door 30. Accordingly, in order to install the fluid storage tank 50 to the door 30, no separate space may be necessary, and the remaining space in the frame unit 310 of the door 30 may be efficiently used.

The fluid storage tank 50 may be formed of a transparent material. In addition, the fluid storage tank 50 may be installed to the door 30 so that one surface of the fluid storage tank 50 is exposed outward (i.e. to the user) when the door 30 is opened.

For example, defining the portion of the cabinet 20 to which the door 30 is installed as the front portion and the opposite portion as the rear portion, the fluid storage tank 50 may be installed to the door 30 so that the rear surface of the fluid storage tank 50 is exposed to the user when the door 30 is opened. Accordingly, when the door 30 is opened away from the cabinet 20, the user may easily check the amount of washing detergent stored in the fluid storage tank 50.

In addition, the door 30 may be provided with an installation portion 350 (or surface) for the installation of the fluid storage tank 50. The installation portion 350 may be recessed and may have a shape corresponding to the shape of the fluid storage tank 50.

In addition, the installation portion 350 is provided with an installation surface 353, and at least one surface of the fluid storage tank 50 is placed on the installation surface 353. More specifically, the frame unit 310 of the door 30 may include a front frame 311, which faces the front side of the cabinet 20, and a rear frame 312, which is coupled to the front frame 311 with a predetermined space therebetween.

At this time, the installation portion 350 may be provided on the front frame 311. In addition, a portion of the rear frame 312 at which the fluid storage tank 50 is disposed is cut away.

That is, the front surface of the fluid storage tank 50 is covered with the front frame 311, whereas the rear surface of the fluid storage tank 50 is exposed outward when the door 30 is opened. Accordingly, when the door 30 is opened, the user may easily check the amount of washing detergent stored in the fluid storage tank 50. In the state in which the door 30 is rotated about the vertical axis Y to thereby be opened, the fluid storage tank 50 may be separated from the front frame 311.

In addition, the fluid storage tank 50 has a thickness that is equal to or less than the sum of thicknesses of the front frame 311 and the rear frame 312. Thus, even if the fluid storage tank 50 is installed on the door 30, the thickness of the door 30 is not increased. That is, the fluid storage tank 50 may be installed in an empty space inside the frame unit 310 of the door 30 that is defined by the thickness of the door 30.

Meanwhile, the fluid storage tank 50 may be connected to a tube 70, which serves to guide the washing detergent stored in the fluid storage tank 50 to the inside of the cabinet 20 (i.e. to the inside of the drum 80). Accordingly, the washing detergent stored in the fluid storage tank 50 may be introduced into the cabinet 20 through the tube 70.

Specifically, one end 71 of the tube 70 may be connected to the fluid storage tank 50, and the other end 72 of the tube 70 may be installed to the frame unit 310 of the door 30 so as to eject the washing detergent toward the convex portions 321, 322 and 323, which is provided in the glass unit 320, from the upper side of the convex portions 321, 322 and 323. In addition, an ejection nozzle may be provided at the other end 72 of the tube 70.

Accordingly, the washing detergent ejected through the other end 72 of the tube 70 may be guided to the inside of the clothes treatment apparatus 10 along the surface of the convex portions 321, 322 and 323. That is, the washing detergent, ejected through the ejection nozzle provided at the other end 72 of the tube 70, may flow down along the upper sloped surface 321 of the convex portion 321, 322 and 323, thereby being guided to the inside of the clothes treatment apparatus 10. Generally, because water supplied into the clothes treatment apparatus is ejected toward the inner surface of the door 30, the washing detergent, which flows down along the upper sloped surface 321, may easily flow down to the inside of the clothes treatment apparatus 10 due to the water ejected toward the inner surface of the door 30.

Meanwhile, one end of the tube 70 may be connected to the lower end of the fluid storage tank 50. This serves not only to allow the washing detergent stored in the fluid storage tank 50 to be easily discharged through the tube 70 due to gravity, but also to allow the washing detergent to be efficiently supplied even in the situation in which the amount of washing detergent inside the fluid storage tank 50 is not great. In the present embodiment, one end of the tube 70 may be connected to a connection hole 51 formed in the lower end of the fluid storage tank 50.

Meanwhile, the clothes treatment apparatus 10 according to the present embodiment may further include a pump 60, which serves to eject the washing detergent stored in the fluid storage tank 50 to the inside of the cabinet 20. For example, the pump 60 may be connected to one side of the fluid storage tank 50. In the case where a plurality of fluid storage tanks 50 is provided, the pump 60 may be connected to each of the fluid storage tanks 50.

The pump 60 may apply pressure to the inside of the fluid storage tank 50 so that the washing detergent in the fluid storage tank 50 is ejected to the inside of the cabinet 20 based on the pressure and/or the time depending on a user command, or based on a preset pressure and/or time depending on a selected course. Meanwhile, in the present embodiment, two fluid storage tanks 50 may be separately provided on the door 30, and the pump 60 may be located between the two fluid storage tanks 50.

For example, the pump 60 may be disposed on the front frame 311 of the door 30 above the glass unit 320, and the two fluid storage tanks 50 may be disposed respectively at opposite sides of the pump 60. At this time, each of the two fluid storage tanks 50 may be connected to the pump 60.

In addition, the two fluid storage tanks 50 may be installed at the upper left and right corner portions of the door 30. At this time, the pump 60 may be connected to each of the two fluid storage tanks 50.

Figure 3:
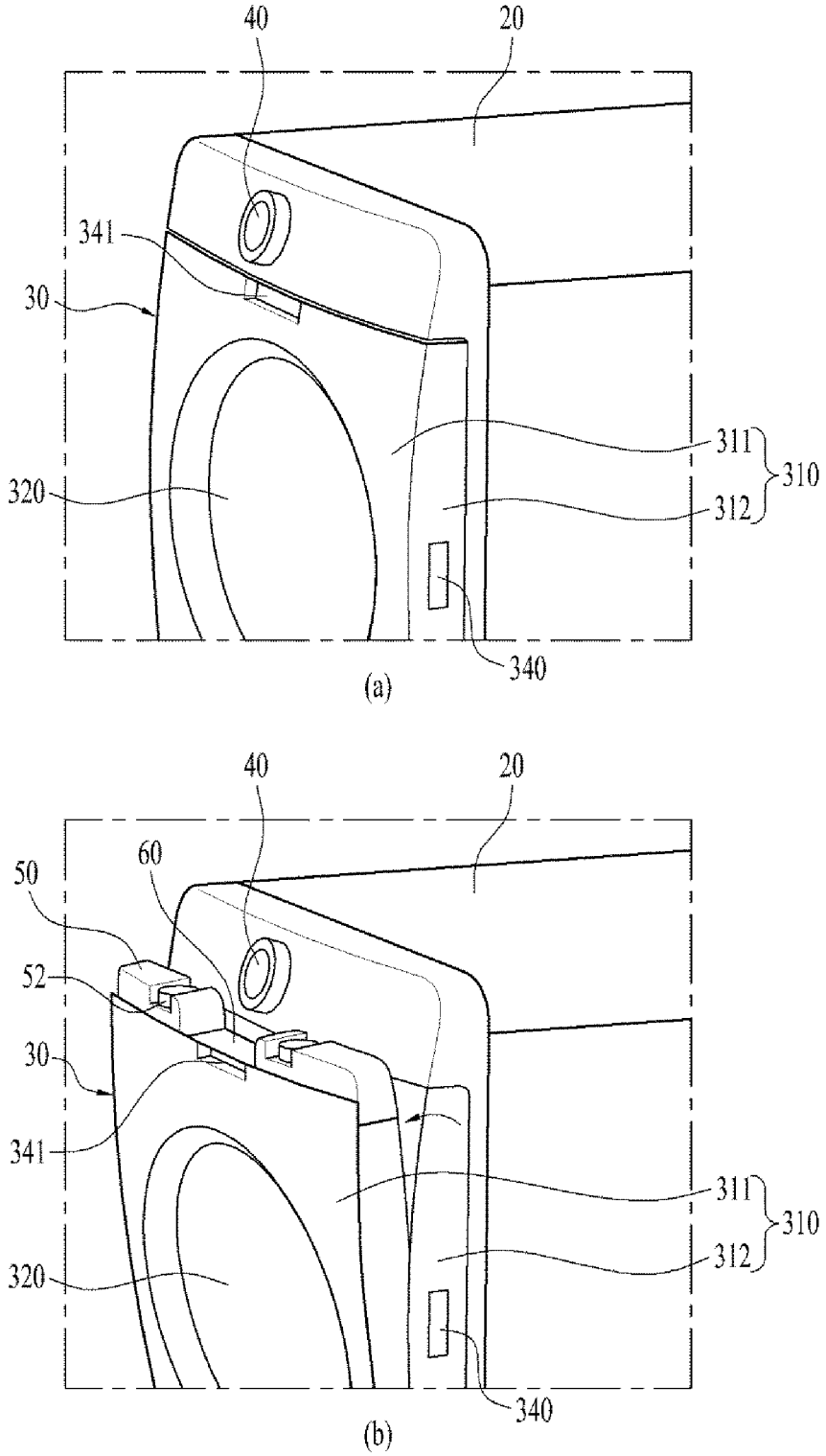
FIG. 3 shows views illustrating the state before a front frame of a door is tilted in the clothes treatment apparatus of FIG. 2 (as shown above with label (a)), and the state in which the front frame of the door is tilted in the clothes treatment apparatus of FIG. 2 (as shown below with label (b)).
Figure 4:
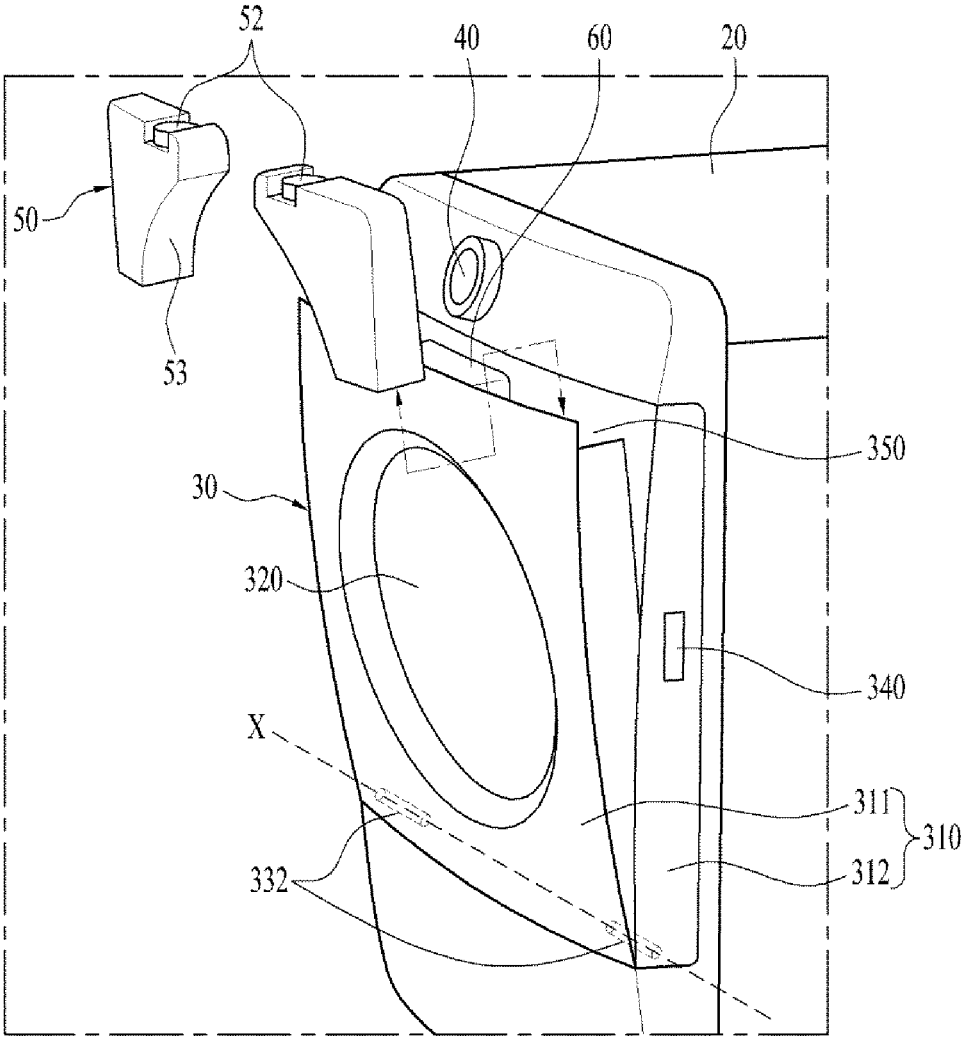
FIG. 4 is a view illustrating the state in which a fluid storage tank provided in the clothes treatment apparatus of FIG. 2 is separated from the door.

Hereinafter, a structure for attaching or detaching the fluid storage tank 50 to or from the door 30 and a method of filling the fluid storage tank 50 with the washing detergent will be described with reference to FIG. 3 and FIG. 4. FIG. 3 illustrates the state before the front frame 311 of the door 30 is tilted in the clothes treatment apparatus 10 of FIG. 2, and the state in which the front frame 311 of the door 30 is tilted in the clothes treatment apparatus 10 of FIG. 2. In addition, FIG. 4 is a view illustrating the state in which the fluid storage tank 50 provided in the clothes treatment apparatus 10 of FIG. 2 is separated from the door 30.

First, referring to FIG. 3, when the door 30 is closed relative to the cabinet 20, the front frame 311 of the door 30 may be tilted relative to the rear frame 312 by a predetermined angle in the front-and-rear direction. That is, in the state in which the door 30 is closed relative to the cabinet 20 (*a*), the front frame 311 of the door 30 may be opened relative to the rear frame 312 by a predetermined angle in the front-and-rear direction.

For example, in the state in which the rear frame 312 of the door 30 is closed relative to the cabinet 20, the front frame 311 of the door may be tilted from the rear frame 312 toward the front side of the cabinet 20. More specifically, by a second hinge unit (or second hinge) 332 provided on the bottom portion of the door 30, which will be described below, the upper end of the front frame 311 of the door 30 may be tilted in the front-and-rear direction relative to the upper end of the rear frame 312 to thereby be opened.

At this time, a second grip portion (or second grip) 341 may be provided on the upper end portion of the front surface of the door 30 (i.e. the upper end portion of the front surface of the front frame 311), in order to open the front frame 311 relative to the rear frame 312. In addition, the second grip portion 341 may be recessed in the upper end of the front surface of the front frame 311.

When the upper end of the front frame 311 of the door 30 is opened, the upper portion of the fluid storage tank 50 installed to the front frame 311 is exposed outward. That is, when the front frame 311 is tilted forward by a predetermined angle relative to the rear frame 312, the upper portion of the fluid storage tank 50 is exposed outward.

At this time, the user may separate the fluid storage tank 50 from the front frame 311 by pulling the fluid storage tank 50 upward. That is, in the state in which the front frame 311 is tilted forward by a predetermined angle relative to the rear frame 312, the fluid storage tank 50 may be separable upward from the front frame 311.

Accordingly, the user can attach or detach the fluid storage tank 50 to or from the door (i.e. the front frame) in a relaxed position without bending the waist. In addition, in the state in which the upper end of the front frame 311 is opened by tilting the front frame 311, the user may separate the fluid storage tank 50 from the front frame 311, and thereafter may open a cover 52 provided in the fluid storage tank 50 so as to introduce the washing detergent into the fluid storage tank 50.

In addition, in the state in which the upper end of the front frame 311 of the door 30 is opened, the user may open the cover 52 provided on the top of the fluid storage tank 50 so as to introduce the washing detergent into the fluid storage tank 50. That is, the user may introduce the washing detergent into the fluid storage tank 50 without separating the fluid storage tank 50 from the front frame 311.

In addition, referring to FIG. 4, in order to allow the front frame 311 of the door 30 to be opened forward relative to the rear frame 312, the second hinge unit 332 may be provided on the bottom portion of the door 30 in the width direction of the door 30. For example, the front frame 311 may be rotated in the vertical direction about a horizontal axis X, which extends in the left-and-right direction on the bottom portion of the door 30, so as to be opened relative to the rear frame 312.

That is, the horizontal axis X represents the axis that extends in the width direction of the door 30 on the bottom portion of the door 30. In addition, the horizontal axis X may be orthogonal to the above-described vertical axis Y.

In addition, the second hinge unit 332 is provided on the bottom portion of the door 30 and connects the front frame 311 and the rear frame 312 to each other so that the front frame 311 may be tilted by a predetermined angle relative to the rear frame 312. Accordingly, after the user opens the front frame 311 relative to the rear frame 312, the user may separate the fluid storage tank 50 installed to the front frame 311 by upwardly pulling the fluid storage tank from the front frame 311.

Conversely, the user may install the fluid storage tank 50 to the front frame 311 by downwardly pushing the fluid storage tank 50 toward the front frame 311, which has been opened away from the rear frame 312. In this way, even though the user does not open the door 30 from the cabinet 20, the user may introduce the washing detergent into the fluid storage tank 50 after opening only the front frame 311 relative to the rear frame 312, or may separate the fluid storage tank 50 for easy maintenance and repair thereof.

Figure 1:
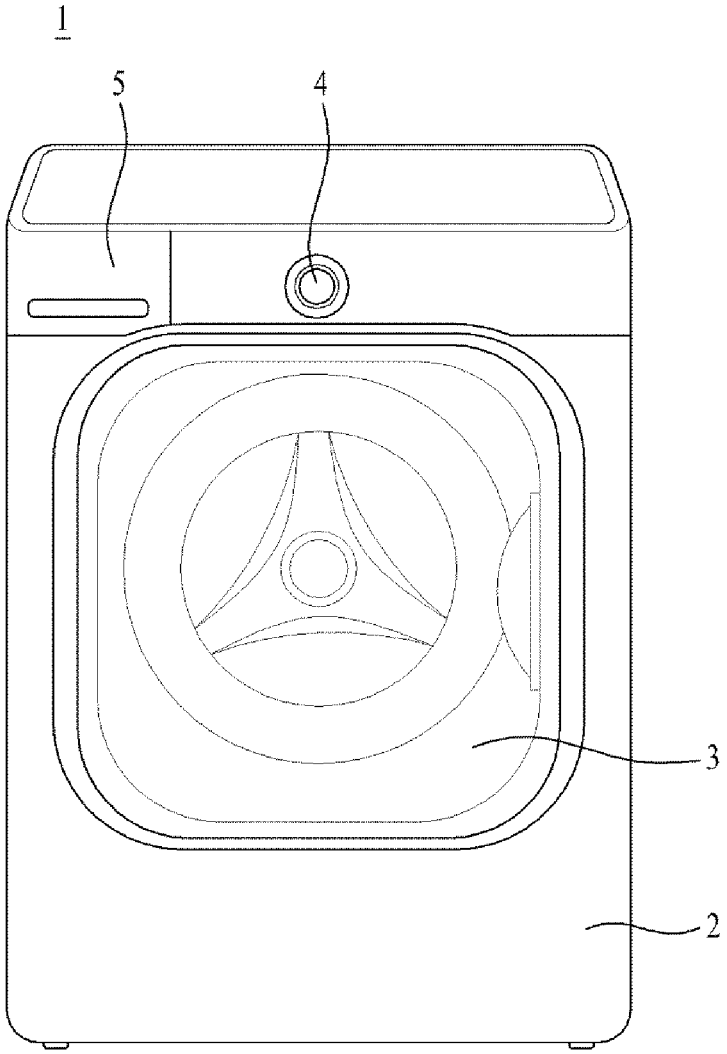
FIG. 1 is a view illustrating a conventional clothes treatment apparatus.

Meanwhile, referring to FIGS. 1 and 4, when viewed from the front side of the cabinet 20, the frame unit 310 may have a rectangular shape and the glass unit 320 may have a circular shape. In addition, when the fluid storage tank 50 is coupled to the door 30, one side surface of the fluid storage tank 50 may be placed on the installation surface 353 provided on the installation portion 350 of the door 30.

At this time, the installation surface 353 may be curved so as to have the same shape as the outer circumference of the glass unit 320 of the door 30. In addition, the side surface of the fluid storage tank 50 that is placed over the installation surface 353 may have a shape corresponding to the shape of the outer circumference of the glass unit 320.

That is, the fluid storage tank 50 may have a curved surface portion 53 having a shape corresponding to the shape of the outer circumference of the glass unit 320. For example, the installation surface 353 may be upwardly convexly formed, and the curved surface portion 53 of the fluid storage tank 50 may be upwardly concavely formed. Accordingly, with the curved surface portion 53 of the fluid storage tank 50, as much of the limited space inside the frame unit 310 of the door 30 as possible may be used as efficiently as possible.

Figure 5:
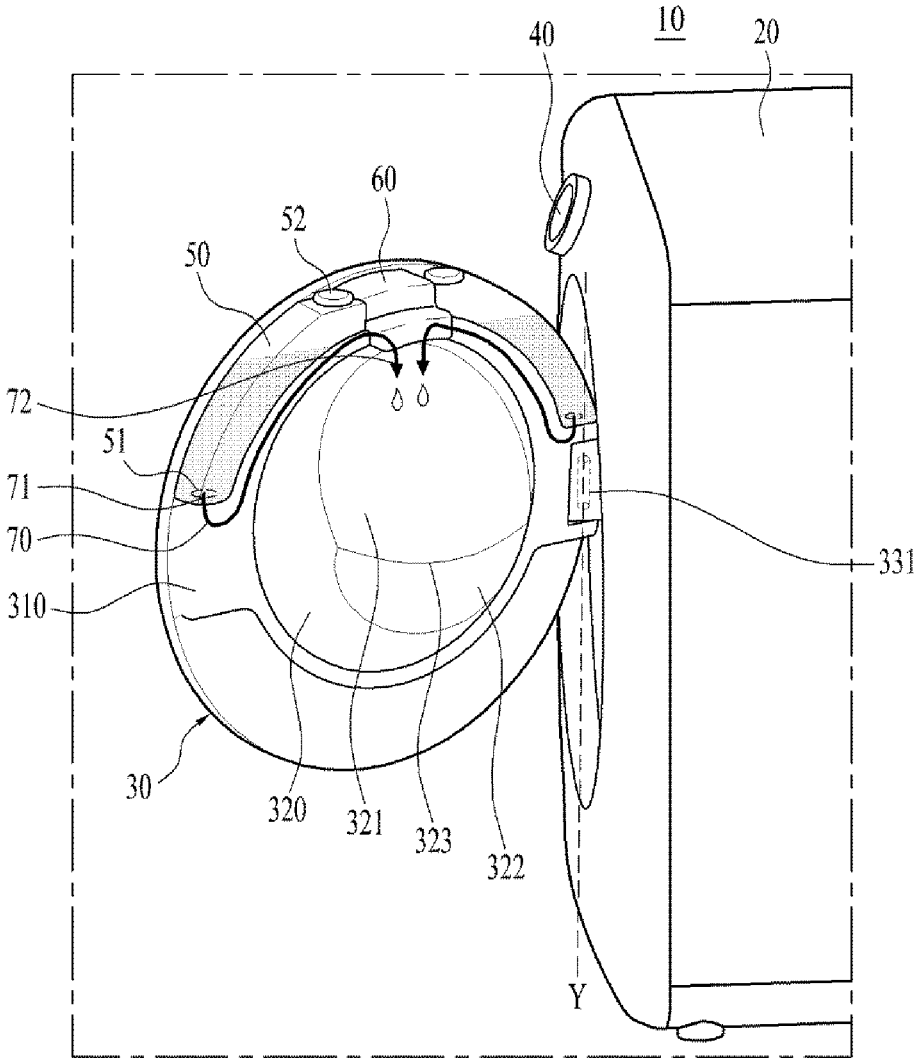
FIG. 5 is a perspective view of a clothes treatment apparatus according to another embodiment of the present invention.

Hereinafter, a clothes treatment apparatus according to another embodiment of the present invention will be described with reference to FIGS. 5 and 6. FIG. 5 is a perspective view of a clothes treatment apparatus according to another embodiment of the present invention, and FIG. 6 is a view illustrating the state in which the fluid storage tank provided in the clothes treatment apparatus of FIG. 5 is separated from the door.

Hereinafter, in the description of the clothes treatment apparatus according to the other embodiment of the present invention, made with reference to FIGS. 5 and 6, components that are the same as or corresponding to those of the clothes treatment apparatus described with reference to FIGS. 2 to 4 will be designated by the same reference numerals. In addition, differences from the clothes treatment apparatus described with reference to FIGS. 2 to 4 will be described below in detail.

Figure 6:
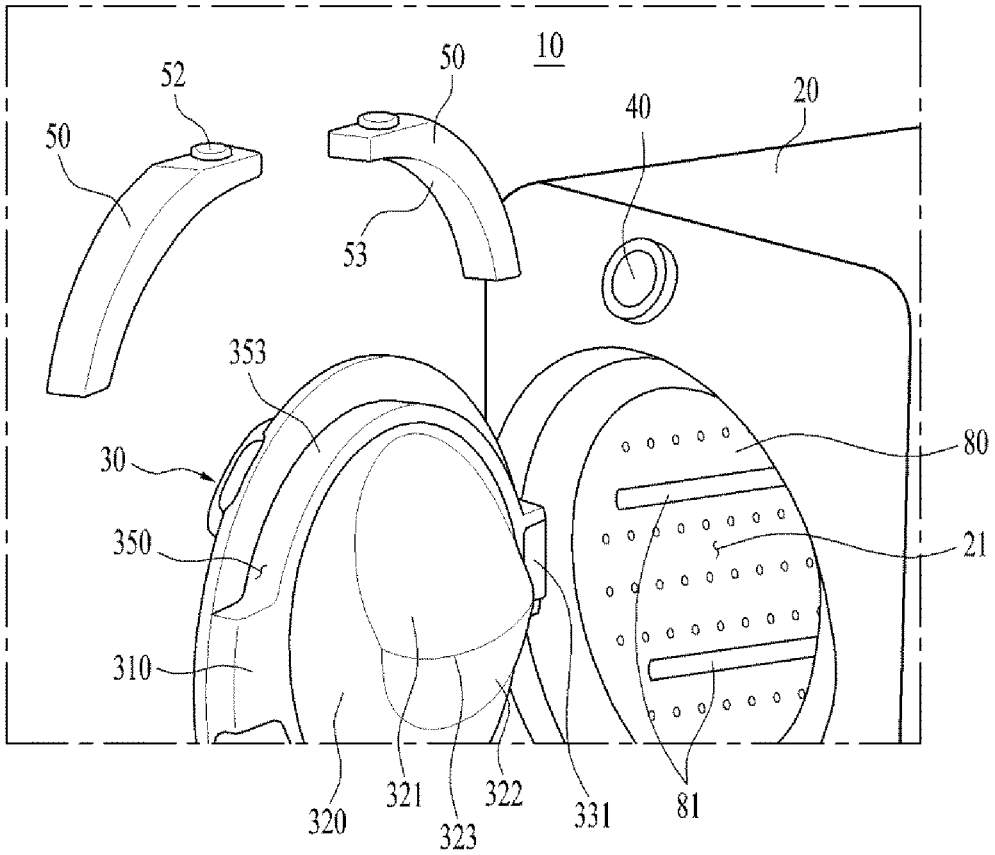
FIG. 6 is a view illustrating the state in which the fluid storage tank provided in the clothes treatment apparatus of FIG. 5 is separated from the door.

Referring to FIGS. 5 and 6, the clothes treatment apparatus 10 according to the other embodiment of the present invention includes the cabinet 20 defining the external appearance of the apparatus, the drum 80, which is rotatably installed in the cabinet 20 and accommodates an object to be treated (i.e. a washing object), and the door 30 installed on the cabinet 20. The drum 80 may be provided with one or more lifters 81 to lift and drop laundry during rotation of the drum 80, and the lifters 81 may be applied to the clothes treatment apparatus of the above-described embodiment of the present invention.

In order to rotate the door 30 (i.e. to open or close the door 30), the hinge unit 331 may be provided between the door 30 and the cabinet 20 so as to be installed along the vertical axis Y. Accordingly, the door 30 may be rotated leftward or rightward relative to the cabinet 20 about the hinge unit 331.

Meanwhile, at least one fluid storage tank 50 may be separably installed to the door 30 and may store a washing detergent to be ejected into the cabinet 20 of the clothes treatment apparatus 10. The present embodiment differs from the embodiment of the present invention described above with reference to FIGS. 2 to 4 in terms of the structure of the door 30 to which the fluid storage tank 50 is installed.

That is, the fluid storage tank 50 is installed to the door 30 and is connected to the pump 60. In addition, one end of the tube 70 is connected to the connection hole 51 formed in the lower end of the fluid storage tank 50, and the other end of the tube 70 may be installed to the frame unit 310 of the door 30 so as to eject the washing detergent toward the convex portions 321, 322 and 323 of the glass unit 320 (i.e. the upper sloped surface 321).

In addition, the cover 52 may be provided on the upper end of the fluid storage tank 50, and the user may introduce the washing detergent into the fluid storage tank 50 after opening the cover 52. In addition, the fluid storage tank 50 may be formed of a transparent material. The fluid storage tank 50 may be installed to the door 30 so that one surface of the fluid storage tank 50 is exposed outward (i.e. to the user) when the door 30 is opened. Accordingly, when the door 30 is opened away from the cabinet 20, the user may easily check the amount of washing detergent stored in the fluid storage tank 50.

Meanwhile, the detailed structure of the door 30, which will be described below, differs from that in the above-described embodiment of the present invention with reference to FIGS. 2 to 4. First, the door 30 is provided with only one hinge unit 331. That is, the door 30 may be rotated about the hinge unit 331 to thereby be opened away from the cabinet 20.

In addition, when viewed from the front side of the cabinet 20, both the frame unit 310 of the door 30 and the glass unit 320 provided in the center of the frame unit 310 have a circular shape. In addition, the installation portion 350 for the installation of the fluid storage tank 50 may be provided on the rear portion of the door 30 (on the rear portion of the frame unit 310).

Accordingly, in the state in which the door 30 is opened away from the cabinet 20, the fluid storage tank 50 may be installed to the installation portion 350 of the door 30 so as to be upwardly separable from the door 30. In addition, the installation portion 350 may be recessed to have a shape corresponding to the shape of the fluid storage tank 50.

Here, the fluid storage tank 50 has the curved surface portion 53 having a shape corresponding to the shape of the outer circumference of the glass unit 320, which is the same as in the above-described embodiment of the present invention. That is, the installation portion 350 may be provided with the installation surface 353, which is curved in the same manner as the outer circumference of the glass unit 320, and the fluid storage tank 50 may be placed over the installation surface 353. At this time, because the curved surface portion 53 of the fluid storage tank 50 has a shape corresponding to the shape of the curved installation surface 353, the space in the frame unit 310 of the door 30 may be efficiently used.

The difference between the embodiment illustrated in FIGS. 5 and 6 and the embodiment illustrated in FIGS. 2 to 4 is that, in the case of the embodiment illustrated in FIGS. 5 and 6, the fluid storage tank 50 is separable from the door 30 only when the door 30 is opened. That is, in the embodiment illustrated in FIGS. 5 and 6, the user needs to first open the door 30 in order to separate the fluid storage tank 50 from the door 30.

Figure 7:
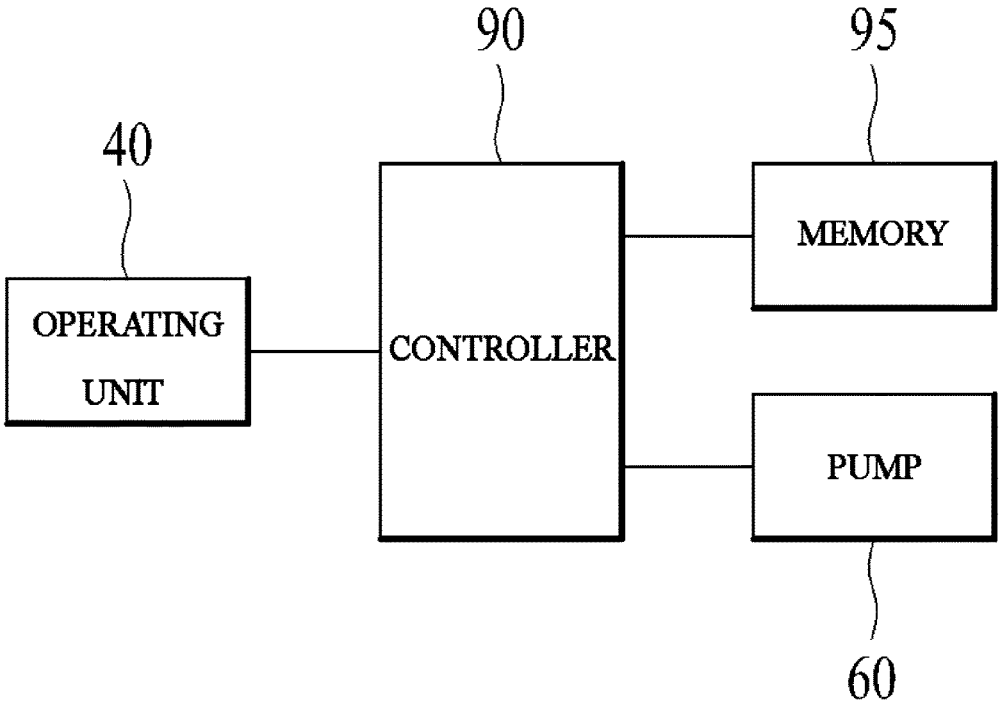
FIG. 7 is a block diagram for explaining a method of controlling the ejection of a detergent, stored in the fluid storage tank, into the clothes treatment apparatus.

Hereinafter, a control method of ejecting the washing detergent stored in the fluid storage tank 50 to the inside of the clothes treatment apparatus 10 will be described with reference to FIG. 7. FIG. 7 is a block diagram for explaining a method of controlling the ejection of the detergent, stored in the fluid storage tank, into the clothes treatment apparatus. All features of a controller 90 illustrated in FIG. 7 may be applied to the above-described embodiment and the other embodiment of the present invention.

Referring to FIG. 7, the clothes treatment apparatus 10 according to the present invention may further include the controller 90. The controller 90 may be electrically connected to the operating unit 40, a memory 95, and the pump 60.

In addition, the controller 90 may be configured to drive the pump 60 based on a command input to the operating unit 40 by the user. For example, the controller 90 may be configured to differently control the pump 60 depending on a user input mode and an automatic control mode.

In the user input mode, the user may directly input the amount of washing detergent to be introduced into the clothes treatment apparatus 10 via the operating unit 40. Of course, the amount of clothes to be washed and a desired course may be input via the operating unit 40.

In this case, the controller 90 may adjust the pressure of the pump 60 and/or the driving time of the pump 60 based on the user input indicating the amount of washing detergent. At this time, the pressure of the pump 60 and/or the driving time of the pump 60 depending on the amount of washing detergent may be stored in advance in the memory 95.

Meanwhile, in the case where the door 30 is provided with two fluid storage tanks 50, the controller 90 may control the pump 60 so that the washing detergent accommodated in the two fluid storage tanks 50 is introduced into the clothes treatment apparatus 10 at the same time. In addition, the controller 90 may control the pump 60 so that the washing detergent accommodated in the two fluid storage tanks 50 is selectively introduced into the clothes treatment apparatus 10.

In addition, in the automatic control mode, the user may input at least one of a desired course and the amount of clothes to be washed via the operating unit 40. That is, the user may not need to input the amount of washing detergent to be introduced into the clothes treatment apparatus 10.

In this case, the controller 90 may determine the amount of washing detergent to be introduced into the clothes treatment apparatus 10 based on at least one piece of information selected from among the course and the amount of clothes to be washed, which are input by the user. In addition, the controller 90 may adjust the pressure of the pump 60 and/or the driving time of the pump 60 based on the determined amount of clothes to be washed.

At this time, the amount of washing detergent depending on the amount of the clothes to be washed and the course may be stored in advance in the memory 95. In addition, the pressure of the pump 60 and/or the driving time of the pump 60 may also be stored in advance in the memory 95. In addition, in both the user input mode and the automatic control mode, in the case where the door 30 is provided with two fluid storage tanks 50, the following two cases may be basically considered.

First, both of the fluid storage tanks 50 may accommodate washing detergent for use in a washing cycle. In this case, the controller 90 may control the pump 60 so that the washing detergent accommodated in the two fluid storage tanks 50 is simultaneously or selectively introduced into the clothes treatment apparatus 1.

Second, one of the two fluid storage tanks 50 may accommodate the washing detergent for use in a washing cycle, and the other one may accommodate a softener for use in a rinsing cycle. In this case, the controller 90 may control the pump 60 so that the pump 60 applies pressure to the fluid storage tank 50, in which the washing detergent is accommodated, during the washing cycle. In addition, the controller 90 may control the pump 60 so that the pump 60 applies pressure to the fluid storage tank 50, in which the softener is accommodated, during the rinsing cycle.

According to the present invention described above, even if the user does not introduce the washing detergent every time the user operates the clothes treatment apparatus 10, an appropriate amount of washing detergent stored in the fluid storage tank 50 may be introduced to the clothes treatment apparatus 10 in a simplified manner via manipulation of the operating unit 40. As described above, the configuration in which the pump 60 is controlled by the controller 90 so as to apply pressure to the two fluid storage tanks 60 simultaneously or selectively is a known technology and is also a technology that may be clearly understood by those skilled in the art, and thus a detailed description thereof will not be described.

Meanwhile, after operating the clothes treatment apparatus 10 multiple times, the user may open the door 30 and check the amount of washing detergent stored in the fluid storage tank 50, in order to replenish the washing detergent in the fluid storage tank 50. At this time, because the opening of the door 30 is performed every time the clothes treatment apparatus 10 is used, the user may frequently check the amount of washing detergent stored in the fluid storage tank 50.

INDUSTRIAL APPLICABILITY

This is included in the content of the specification.

The invention claimed is:

1. A clothes treatment apparatus comprising:

a cabinet;

a drum rotatably installed in the cabinet and configured to accommodate an object to be treated; and a door installed on a front side of the cabinet, wherein the door includes at least one storage tank configured to store at least one of a detergent and a fabric softener, wherein the door includes a frame and a transparent glass window provided in a center of the frame, and wherein the at least one storage tank is provided on the frame, wherein the at least one storage tank is connected to a tube which guides the detergent or the fabric softener stored in the at least one storage tank to an inside of the cabinet, and wherein the glass window includes a convex portion protruding toward the inside of the cabinet, and wherein the tube has a first end connected to the at least one storage tank, and a second end positioned on the frame so as to eject the detergent or the fabric softener toward the convex portion from an upper side of the convex portion.

2. The apparatus according to claim 1, wherein the at least one storage tank is formed of a transparent material, and wherein, when the door is opened, a rear surface of the at least one storage tank is exposed.

3. The apparatus according to claim 1, wherein the door is provided with an installation surface on which the at least one storage tank is provided, the installation surface having a shape corresponding to a shape of the at least one storage tank.

4. The apparatus according to claim 3, wherein the door includes a front frame facing the front side of the cabinet and a rear frame opposite the front frame, and wherein the installation surface is provided on the front frame.

5. The apparatus according to claim 4, wherein a first side of the door includes a first hinge in a vertical direction of the door so that the door is rotated leftward or rightward relative to the cabinet, and wherein a bottom of the door includes a second hinge in a horizontal direction of the door so that the front frame is tilted in a front-and-rear direction by a predetermined angle relative to the rear frame.

6. The apparatus according to claim 5, wherein, when the front frame is tilted forward by the predetermined angle relative to the rear frame, an upper portion of the at least one storage tank is exposed outward.

7. The apparatus according to claim 6, wherein the at least one storage tank is upwardly separable from the front frame when the front frame is tilted forward by the predetermined angle relative to the rear frame.

8. The apparatus according to claim 3, wherein the at least one storage tank is upwardly separable from the door when the door is opened away from the cabinet.

9. The apparatus according to claim 1, wherein the first end of the tube is connected to a lower end of the at least one storage tank.

10. The apparatus according to claim 1, further including a pump configured to eject the detergent or the fabric softener stored in the at least one storage tank to an inside of the cabinet.

11. The apparatus according to claim 10, wherein the door includes two storage tanks separated from each other, and wherein the pump is located between the two storage tanks.

12. The apparatus according to claim 1, wherein the frame has a rectangular shape and the glass window has a circular shape when viewed from the front side of the cabinet, and wherein the at least one storage tank includes a curved surface having a shape corresponding to a shape of an outer circumference of the glass window.

13. The apparatus according to claim 1, wherein each of the frame and the glass has a circular shape when viewed from the front side of the cabinet, and wherein the at least one storage tank includes a curved surface having a shape corresponding to a shape of an outer circumference of the glass window.

14. The apparatus according to claim 1, wherein the at least one storage tank is removable, and wherein the at least one storage tank is adjacent to an upper portion of the transparent glass window.

15. A clothes treatment apparatus comprising:

a cabinet;

a drum rotatably installed in the cabinet and configured to receive laundry; and a door including a front frame and a rear frame, wherein the rear frame of the door is connected to the cabinet by at least one first hinge rotating about a first axis, and the front frame is connected to the rear frame by at least one second hinge rotating about a second axis, the first and second axes being different from each other, and wherein the door further includes at least one storage tank configured to store at least one of a detergent or a fabric softener, wherein the door further includes a transparent glass window surrounded by the rear frame, and wherein the at least one storage tank is provided on an installation surface of the rear frame partially surrounding the glass window.

16. The clothes treatment apparatus according to claim 15, wherein the at least one storage tank is connected to a first end of a tube which guides the detergent or the fabric softener from the at least one storage tank to an inside of the drum.

17. The clothes treatment apparatus according to claim 16, wherein a second end of the tube is positioned on the rear frame and aimed toward a convex rear face of the transparent glass window.

18. The clothes treatment apparatus according to claim 15, wherein the at least one storage tank is removable, and wherein the at least one storage tank is adjacent to an upper portion of the transparent glass window.

* * * * *